United States Patent [19]

Ziegelmeyer

[11] 4,009,742

[45] Mar. 1, 1977

[54] WOOD-WORKING MECHANISM

[76] Inventor: Harold R. Ziegelmeyer, 5010 Griffin Creek Road, Medford, Oreg. 97501

[22] Filed: Nov. 28, 1975

[21] Appl. No.: 635,906

[52] U.S. Cl. ..... 144/230; 29/105 R; 144/90 R; 144/117 B; 144/218

[51] Int. Cl.[2] ..... B27G 13/04

[58] Field of Search ..... 144/90 R, 90 A, 91, 144/114 R, 117 R, 117 B, 116, 117 A, 172, 174, 218, 230, 321, 323, 326 A, 326 B, 326 C, 221; 29/105 R; 241/292.1, 294

[56] References Cited

UNITED STATES PATENTS

| | | | |
|---|---|---|---|
| 995,040 | 6/1911 | Stevens | 144/230 |
| 2,521,868 | 9/1950 | Otto | 144/230 |

*Primary Examiner*—Frank T. Yost
*Assistant Examiner*—W. D. Bray
*Attorney, Agent, or Firm*—Clarence M. Crews

[57] ABSTRACT

Mechanism is provided for grooving or planing wood products either lengthwise or crosswise. Such grooving may be preparatory to the interdigital end to end interfitting of work pieces, commonly referred to as finger-jointing, or to simple planing which involves the continuous, uniform smoothing of a surface from end to end throughout its entire width, or to uniform longitudinal or transverse slotting. In any of these operations the cutting blade edges become dull and require resharpening from time to time. Conventionally the outer face of the blade which confronts the work is ground away for sharpening, and this has the unfortunate consequence of shortening the blade and thereby reducing the depth of cut. In accordance with the present invention this difficulty is overcome. The blade is formed with parallel, upwardly and forwardly sloping inner and outer faces, and the blade is sharpened by evenly grinding away the forward face of the blade. By providing adjustable means on a blade carrying wheel for wedging the blade forward on an outward slope as far as possible, a blade which has had its forward face evenly ground away can be caused to pick up where it left off--to-wit, to cut to exactly the same depth as before resharpening.

7 Claims, 5 Drawing Figures

WOOD-WORKING MECHANISM

This invention relates to wood-working mechanism, and more particularly to mechanism for planing, groving or multiple slotting work pieces.

While the invention is equally applicable to a mere planing machine, a mere grooving machine, or to a finger-jointing machine which involves multiple slotting, it will be described primarily in relation to the most exacting of the three—a finger-jointing machine.

In a finger-jointing machine, lengths of two by fours, for example, which have been cut off at random lengths to eliminate all defective portions containing cracks or knots, are then slotted at their ends to form potential finger-joints, and, after the application of adhesive, are wedged together end to end to form composite structures of high quality and of any desired lengths.

In a procedure of this kind it is important that the fingers on the work pieces and the slots formed in the work pieces be of precisely complementary conformation. The slots should be flared and the fingers should be correspondingly tapered, and the slots should correspond in depth to the length of the fingers. The toothed blades mounted on a wheel should be of identical construction, and corresponding teeth of the several blades on the wheel should precisely track one another.

In accordance with conventional practice, when a cutting blade edge becomes dull, the top of the blade is ground off. In consequence, the protrusion of the blade beyond the periphery of the blade carrying wheel is reduced, the slot depth is diminished, and the snug interfitting of fingers and slots is impaired. A primary purpose of the present invention is to avoid this defeciency.

This objective is achieved by beveling the inner and outer ends of each blade uniformly at corresponding upward and forward angles, and sharpening the blade by grinding away a portion of the leading face of the blade uniformly. By this procedure a sharp leading outer edge is produced without changing the effective height of the leading face of the blade. Thus, by crowding the newly ground leading face of the blade against the leading face of the wheel slot in which the blade is carried, the position of the sharpened cutting edge of the blade can be maintained in precisely the same location as the blade is progressively reduced in thickness, and the effective cutting radius of every blade is maintained uniform.

For crowding the blade forward the rear face of the blade is made to include a portion which diverges from the leading face of the blade as it progresses inward, and a wedge having a face of complementary slope is drawn inward by a plurality of headed bolts which are desirably threaded at their inner ends into or through a barrel nut.

As the wedge is drawn inward, it presses the blade forward, so that the cutting edge occupies precisely the same position occupied by it before resharpening.

The point should not be overlooked that the wedge not only crowds the blade forward to a predetermined position, but that it also overlies a portion of the blade, trapping it against ejection from the wheel, by centrifugal force.

When grinding the leading faces of the blades it is desirable that all the blades to be used on a single wheel be removed from the wheel and ground simultaneously at a single operation, with all of their leading faces in a common plane. By this procedure all the blades of a set are maintained of uniform thickness and will reach a condition for discardation simultaneously. To this end, it is a feature that each blade, besides having a wedgable rear face portion, have also an outer rearwardly projecting portion and an inner cut-away portion which lie in a common plane that is parallel to the leading face of the blade. Supported by these surfaces during grinding the thickness of the blade is reduced while maintaining the parallelism of the inner and outer faces and the distance between said faces.

Simultaneous grinding of all blades used together not only reduces the frequency of interruptions for replacement of blades but it assures uniform thickness of the blades used together and therefore uniform weight of the blades used together. This assures maintenance of balance of the wheel, a very desirable objective.

It is very important for finger-jointing, or for mere grooving, that corresponding teeth on the several blades track one another precisely. To this end, it is a feature that each wheel has a plane surfaced abutment disc firmly secured to it to serve as a common end abutment for all the blades.

Other objects and advantages will hereinafter appear.

In the drawing forming part of this specification,

FIG. 1 is a view in side elevation of an illustrative cutting wheel on which several, illustratively eight, cutting blades are normally carried, all having their cutting edges protruding equally beyond the circular periphery of the wheel, itself;

FIG. 2 is a fragmentary view on a larger scale than FIG. 1, showing in detail the relationship of the wheel and a single blade to wedging means whereby the blade, before and after blade grinding will be caused to be firmly and securely wedged into place and will be caused to maintain the cutting edge in the same cutting position as before, i.e., protruding to the same extent beyond the circular periphery of the wheel;

Figure 1:
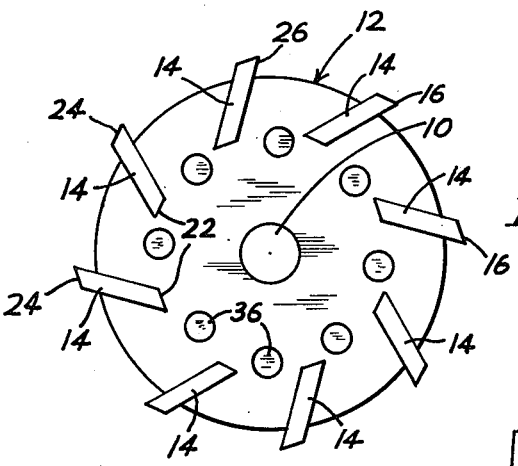

In FIG. 1 a shaft 10 has fast upon it a wheel 12. The illustrative wheel 12 has affixed to it several, illustratively eight, cutting blades 14, all of which are desirably identical and protrude equally beyond the periphery of the wheel 12. The purpose is to cause a board or beam fed past the wheel 12 to be planed or notched to a uniform level or depth by the blades 14. Because of the smallness of scale of FIG. 1, details of blades and blade locking means are ignored in FIG. 1 but are clearly illustrated in FIG. 2.

It is obvious, of course, that in the course of use the cutting edges 16 of the blades 14 will become dulled and worn away and will require sharpening.

Figure 2:
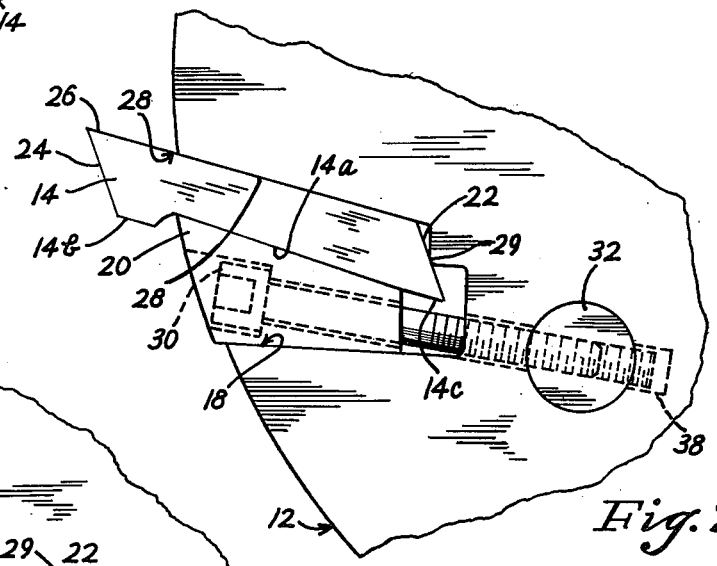
Figure 3:
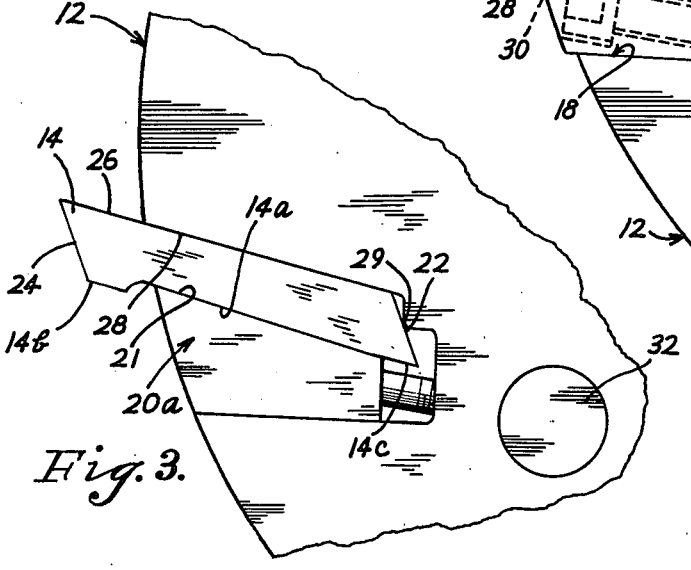
FIG. 3 shows the same blade after grinding in its relationship to the wheel and to wedging means whereby the relationship of the new cutting edge of the blade to the wheel is held unchanged.
Figure 4:
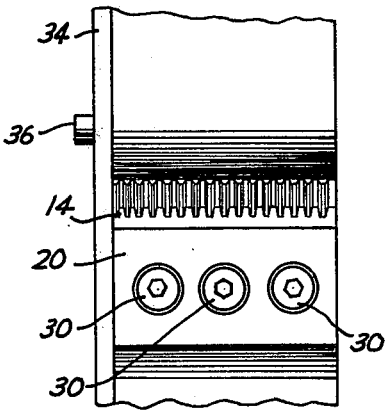
FIG. 4 is a fragmentary end view showing particulary a portion of the wheel together with screws and a screw-actuated wedge which cause the blade to be securely clamped and retained in place before and after grinding.
Figure 5:
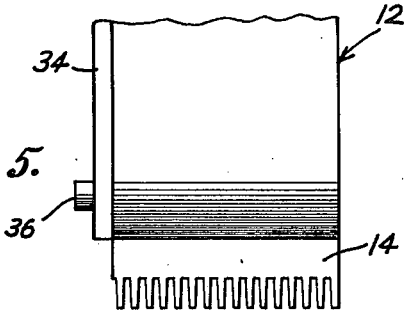
FIG. 5 is a fragmentary end view in which a cutter blade is notched and toothed for finger-jointing purposes.

A primary object of the present invention is to enable every individual blade to be sharpened without changing the depth of cut which will be made by its cutting edge 16. To this end the detailed structure illustrated particularly in FIGS. 2, 3 and 4 is provided.

The wheel 12 is formed with slots 18 to accommodate in each instance both a blade 14 and a wedge 20. Every blade 14 is made long enough initially to protrude for a predetermined, identical distance beyond the periphery of the wheel 12. Each blade 14 is made with formwardly and outwardly sloping inner and outer faces 22 and 24 which are parallel to one another, and with a flat forward face 26 which desirably bears continuously against a flat forward face 28 of the slot 18. The inner face of the blade invariably bears against a wheel abutment 29.

Cooperative with each blade 14 is a wedge 20. The wedge 20 has a forward face 21 which slopes uniformly forward a little more sharply than the forward face 26 of the associated blade 14, while a substantial portion **14*a* of the rear face of each blade 14 is complementary in slope to the slope of the forward face of the associated wedge 20. The wedge 20 tapers in thickness from its outer end to its inner end, so that as it is forced inward it presses the blade 14** inward and forward, locking the latter securely in place.

Wrench operable headed bolts 30 have their shanks passed freely inward through the wedge 20 and threaded into a barrel nut 32. There is sufficient clearance between the shank of each bolt 30 and the passages of the wedge 20 and the wheel 12 through which it extends, and also between the head of the bolt 30, and the portion of the wedge 20 in which it is lodged, to permit limited tilting of the bolt 30 relative to the wedge and the wheel. The inner end of the bolt 30, threaded into the barrel nut 32, can turn to a limited, but useful, extent in unison with the barrel nut about the axis of the barrel nut. It can, therefore, be threaded into the barrel nut far enough to press the wedge 20 down, and to hold it firmly, in blade-clamping position.

It should be noted that even if the bolt 30 should back off slightly, the wedge 20 will still prevent separation of the blade 14 from the wheel 12.

Each blade 14 could be individually withdrawn, sharpened and replaced as the need arises, without disturbance of the other blades.

In the interest of economy, and of maintaining uniformity of weight, and of sharpness and effectiveness of all the blades used together on a wheel, however, it is desirable that all the blades 14 be removed from the machine for sharpening at the same time. The blades are placed on a common, flat-faced magnetic carrier with the faces 26 up and disposed in a common horizontal plane, so that their faces 26 can be simultaneously, equally ground in parallelism with a plane in which coplanar face segments **14*b* and 14*c*** lie.

It is not essential, of course, that operation of the machine be interrupted while the blade grinding is in progress since any group of eight blades, removed from the machine for grinding, can be replaced with any other group of eight which have been used together and ground together, or with a set in its original condition. Any set of eight blades which has been used together should desirably, however, be sharpened together and used together as a set until they have been worn out, so that they may be discarded together.

I have found that a blade may be adequately resharpened by reducing its thickness by 0.002 inch, and that with the setup of FIG. 2 twelve resharpenings of each blade, for a total thickness reduction of 0.024 inch per blade, can readily be made available.

In FIG. 3 a substitute wedge **20*a* is employed, exceeding the wedge 20 in thickness by 0.024 inch but in all other respects a duplicate of the wedge 20.** This second wedge makes twelve more sharpenings, each involving a blade thickness reduction of 0.002 inch available.

Additional sets of wedges, each 0.024 inch thicker than the wedges of the set which precedes it, may be provided and used so long as the blades remain thick enough to have the required rigidity.

The wheel is provided with recesses 38 for accommodating the leading, inner, ends of the bolts 30.

Specific dimensional figures used herein are, of course, purely illustrative and may be varied so long as the principles involved are not violated.

It is a matter of prime importance, when toothed blades are used, as for finger-jointing, that corresponding teeth on the several blades carried by a wheel precisely track one another. Needless to say, the several blades used together on a wheel will be exact duplicates of one another, and their teeth, and spaces between teeth, must be identically located so that they will track one another. A stop place 34, having a plane face for engagement with the wheel 12, is accordingly made fast on the wheel 12 by headed screws 36, and each of the identical blades 14 is made to abut the stop plate.

I have described what I believe to be the best embodiment of my invention. What I desire to cover by letters patent, however, is set forth in the appended claims.

What I claim is:

1. Wood-working mechanism comprising the combination of a. a blade carrying cutter wheel having a plurality of peripheral blade and wedge carrying slots, b. a series of blades carried in the respective slots of the wheel, and constructed and arranged to protrude fixedly and equally outward beyond the periphery of the wheel, when wedged tightly in their assigned positions in their respective slots, each blade having parallel inner and outer surfaces at its opposite ends which slope equally outward and forward, a flat forward surface, and a rear surface which includes a wedgable portion through which the blade may be urged forward, c. a wedge member associated with each blade in its wheel slot constructed and arranged to force the blade forward to a definite, assigned limit of forward movement relative to the wheel, d. means in each slot for engaging the inner surface of the blade to force it outward as an incident of its being forced forward, and e. means for individually forcing each wedge member inward to an inner limit of movement determined by the thickness of the blade, and positively retaining it there.

2. Wood-working mechanism as set forth in claim 1 in which the means for individually forcing each wedge member inward comprises a bolt member having a threaded shank received in the wedge member and free to tilt therein, a wedge tightening head also free to tilt in the wedge member, and a nut into which the shank of the bolt member is threaded at its inner end.

3. Wood-working mechanism as set forth in claim 2 in which the nut is a barrel nut, and a plurality of tiltable bolt members is screwed into the barrel nut.

4. Wood-working mechanism as set forth in claim 1 in which each blade includes coplanar surfaces at the inner and outer extremities of its trailing face, which lie in a common plane parallel to the leading face of the blade.

5. Wood-working mechanism as set forth in claim 1 in which the blades to be used together on a wheel are of identical construction and means are provided for assuring that the blades are mounted on the wheel in precisely tracking relation.

6. Wood-working mechanism as set forth in claim 5 in which the means for assuring that the blades are mounted on the wheel in precisely tracking relation comprises a flat end surface on the cutter wheel disposed at right angles to the wheel axis, a flat disc affixed to the cutter wheel which covers an entire end of the cutter wheel, including the slots thereof, and means securing the disc to the cutter wheel in firm engagement with an end of the wheel and a corresponding end of each of the blades.

7. A cutting blade for use in wood-working mechanism that is designed always to carry the cutting edge of the blade forward in a uniform circular path of predetermined radius, said blade having parallel outwardly and forwardly inclined inner and outer terminal faces, a front flat face structure which can be uniformly ground away for sharpening the outer cutting edge of said face structure without changing the direction or the inner to outer effective length thereof, and a rear face which includes a wedgable structure that diverges inwardly from the front face structure said rear face having inner and outer co-planar portions at opposite ends of said wedgable portions which lie in a plane parallel to the front face, for supporting the front flat face structure during sharpening of the blade in an attitude adapting it to be ground away uniformly throughout the entirety of the front face structure while maintaining the dimensions and direction of the front face structure unchanged.

* * * * *